US005887294A

United States Patent [19]

Yeung

[11] Patent Number: 5,887,294

[45] Date of Patent: Mar. 30, 1999

[54] FLOW-RESTRICTING TOILET BOWL REFILL TUBE DISCHARGE

[76] Inventor: Kwong Yu Yeung, 139 Sandringham Pl. N.W., Calgary, Alberta, Canada, T3K

[21] Appl. No.: 866,318

[22] Filed: May 30, 1997

[51] Int. Cl.[6] ..... E03D 1/00

[52] U.S. Cl. ..... 4/415; 138/44

[58] Field of Search ..... 4/353, 415; 138/44, 138/40; 239/602

[56] References Cited

U.S. PATENT DOCUMENTS

| | | | |
|---|---|---|---|
| 83,395 | 12/1868 | Perry | 239/602 X |
| D. 270,659 | 9/1983 | Marmon et al. | D23/69 |
| 2,694,296 | 11/1954 | Prosek et al. | 138/44 X |
| 2,743,459 | 5/1956 | Schmidt et al. | 4/353 |
| 2,790,463 | 4/1957 | Delano et al. | 138/44 |
| 3,086,546 | 4/1963 | Brown | 137/436 |
| 3,319,913 | 5/1967 | Schoepe et al. | 4/353 X |
| 4,327,941 | 5/1982 | Schoepe | 4/353 X |
| 4,429,423 | 2/1984 | Syrenne | 4/225 |
| 4,449,259 | 5/1984 | Davies et al. | 4/415 |
| 4,960,260 | 10/1990 | McEnearney | 251/127 |
| 4,980,932 | 1/1991 | Stemples | 4/415 |
| 5,134,729 | 8/1992 | Shaw | 4/415 |
| 5,287,565 | 2/1994 | Auman et al. | 4/415 |
| 5,625,907 | 5/1997 | Svoboda | 4/353 |

FOREIGN PATENT DOCUMENTS

WO 91/17382 11/1991 United Kingdom ..... 138/44

*Primary Examiner*—J. Casimer Jacyna
*Assistant Examiner*—Kathleen J. Prunner
*Attorney, Agent, or Firm*—Millen, White, Zelano, & Branigan, P.C.

[57] ABSTRACT

Apparatus and a process is provided for restricting that portion of the flow of water which is directed through a tube to refill the bowl of a toilet after a flush. Typically, the bowl refills before the toilet tank fills so that some water overflows the bowl and is wasted down the sewer. Accordingly, a conduit is connected to the discharge of the bowl refill tube. The conduit has a tapered bore which diminishes continuously from its inlet to its outlet. The diameter of the bore at the conduit's outlet does not permit sufficient water to discharge and refill the bowl after a flush. The conduit is formed of material which is readily cut. An objective bowl water is established. In a process of progressively trimming back the outlet of the conduit, an ever larger and larger diameter bore is exposed, increasing the amount of water discharged. Eventually, enough of the conduit is trimmed so that the operating water level in the bowl is tailored to the toilet's unique characteristics, reaching the objective water level and avoiding waste.

3 Claims, 4 Drawing Sheets

11
22
27
20
25
21
12
28
III.
III.
26
23
12

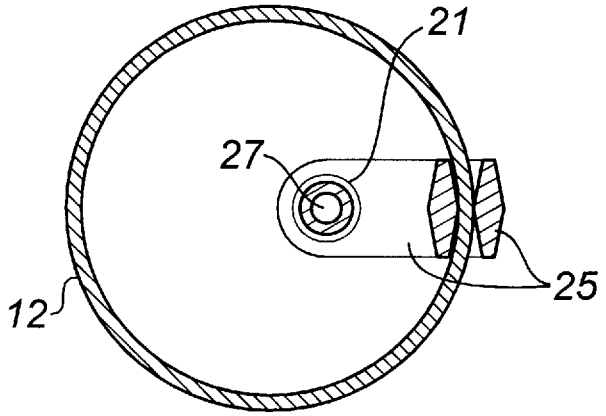
FIG. 3.
FIG. 4A.
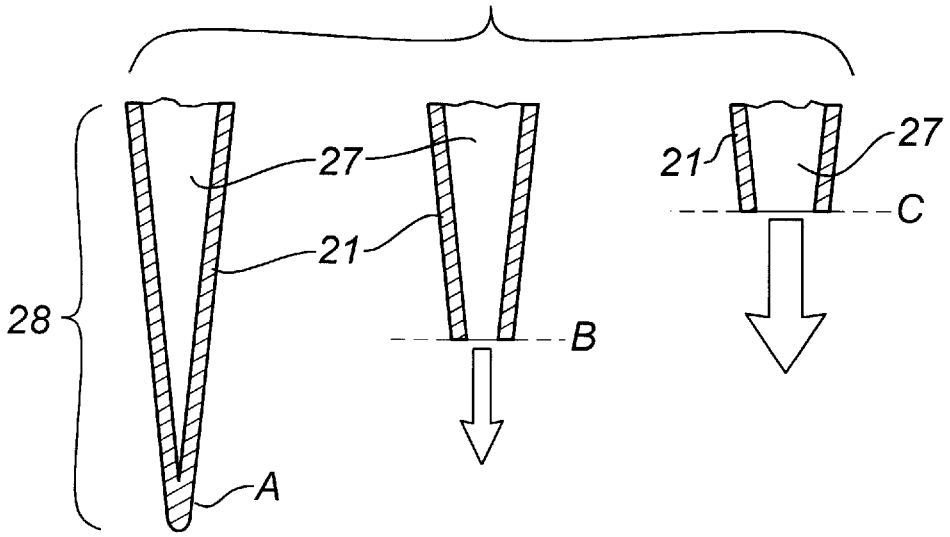
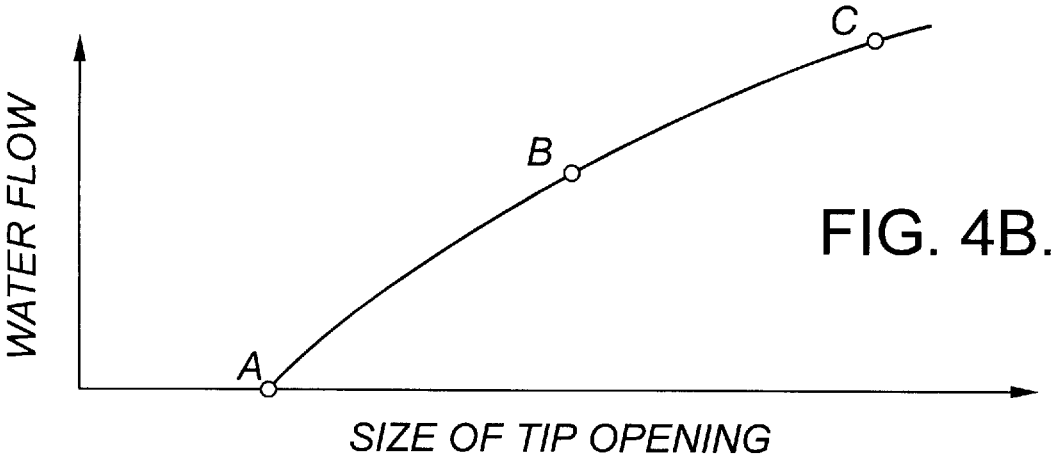
FIG. 4B.

FLOW-RESTRICTING TOILET BOWL REFILL TUBE DISCHARGE

FIELD OF THE INVENTION

The present invention relates to apparatus for conserving water use in a toilet. More specifically, a flow-restriction is placed at the termination of the toilet bowl refilling tube for infinitely varying the water flow therethrough.

BACKGROUND OF THE INVENTION

In a conventional domestic toilet, only one valve controls the refilling functions of both the tank and the toilet bowl after flushing. One tube refills the tank, and a second tube refills the toilet bowl. When open, the valve supplies water to both tubes simultaneously. Water only ceases to flow when the tank becomes full of water, lifting a float ball to shut off the valve.

Should the tank become too full, it spills into an overflow tube which directs water to the toilet bowl. The bowl refill tube discharges water into the overflow tube so that, in the normal course of events, water is also directed to the toilet bowl.

The bowl has a water trap at its base, which seals against the escape of sewer gas and establishes a maximum water level in the bowl before overflowing to the sewer. If the bowl refills to its maximum level before the tank is full then the valve continues to supply excess water to the bowl which overflows and is wasted as it is lost down the sewer.

In conventional domestic toilets the bowl refill tube typically fills the bowl before the tank refill tube fills the tank. By ensuring the bowl fills first one can be assured of a water seal and the bowl is maintained in its cleanest state. Unfortunately, this results in wasted water.

Toilets from, different manufacturers and even similar toilets have individual refill characteristics. Use of a flow-restriction device which has one or even several possible flows is inadequate to balance bowl and tank fill rates across a range of different toilets.

In U.S. Pat. No. 5,134,729 to Shaw, one or more flow nozzles or conduits are inserted within the termination of the bore of the bowl refill tube. If the original flow rate of water to the bowl is too great, then a conduit having a smaller diameter bore than that of the refill tube is inserted. If the flow is still too great, then a second smaller conduit is inserted within the bore of the first conduit. Each conduit causes a step reduction in the flow rate. This method is severely limited by the availability of suitably sized conduits. Further, the number of subsequent incremental insertions is limited by the cumulative wall thickness of the conduits. Shaw only contemplates two incremental restrictions to the flow.

In U.S. Pat. No. 5,287,565 to Auman et al., like Shaw, a device is installed at the termination of the bowl refill tube. The device comprises a chamber having a linear array of identically sized discharge tubes. The device is attached to the overflow tube. The discharge tubes divide the bowl refill flow between either the overflow tube or the tank. The bowl refill rate is adjusted by selecting how many of the discharge tubes direct their flow to the overflow tube (and thus the bowl) and by difference, how many direct their flow to the tank. The balance between bowl and tank flow is limited to a finite number of steps, defined by the number of discharge tubes and the space provided by the overflow tube.

Due to the variability of toilet bowl fill rates, even among identical toilet models, the prior art devices are not able to ensure proper balance between tank and bowl refill rates, resulting in continued waste of water in many cases.

SUMMARY OF THE INVENTION

The apparatus of the present invention provides an infinite range of adjustment of the bowl refill rate and thereby conserves water in a greater number of cases than has been achieved heretofore.

In the preferred embodiment a small plastic conduit or tip is connected to the and of the bowl refill tube. The tip has a tapered bore which diminishes in diameter as it nears the tip's outlet. The tip discharges to the overflow tube and thus the toilet bowl. The tip's outlet does not permit enough water to flow into the bowl to refill it after a flush. By progressively cutting back the plastic tip's outlet, larger and larger bores are exposed. Greater water discharge rates result, permitting a balance to be achieved between the bowl refill rate and the toilet tank refill rate, and thereby avoiding needless waste of water down the sewer.

In a broad aspect then, apparatus is provided comprising:

a flow-restriction conduit having an inlet end adapted to mate to the bowl refill tube, a bore, and an outlet end which directs water into the overflow tube, the bore of which is tapered so that the diameter of the bore diminishes continuously from the inlet to the outlet end, the outlet being insufficiently large in diameter to discharge enough water to overfill the bowl by the time the tank is refilled, the flow-restriction conduit being formed of material which is readily cut so that when it is cut substantially transverse to its bore and intermediate between the inlet and outlet ends, it forms a new outlet end having a larger diameter bore which conducts a greater flow of water to the overflow tube.

Preferably, a pair of prongs are formed integral with the conduit for securing the flow-restriction conduit to the overflow tube so that the outlet discharges water into the overflow tube.

The apparatus enables one to practice a process which balances the bowl refill rate and the tank fill rate so as to establish a water level in the bowl which meets the user's objectives and avoids waste.

More particularly, the process comprises:

establishing the maximum bowl water level before water is lost down the trap;

establishing an objective water level which is between the maximum level and the minimum level necessary to maintain a water seal;

installing a flow-restriction conduit having a tapered bore;

flushing the toilet and determining the operating level in the bowl;

repeatedly and progressively trimming back the tapered portion of the conduit and flushing the toilet until the operating level is the same as the objective water level.

BRIEF DESCRIPTION OF THE DRAWINGS

FIG. 3 is a cross-section of the overflow tube and of the prongs used to secure the restriction tip to the overflow tube, as sectioned along line III—III of FIG. 2.

FIGS. 4*a* and 4*b* illustrate the relationship between trimming of the flow-restriction tip and the water discharge rate. More specifically:

FIG. 4*a* is a series of cross-sectional views of the tapered section of a flow-restriction tip wherein three cases are presented showing no flow, low intermediate flow and high intermediate flow; and FIG. 4*b* is a graph of water flow versus the extent of which the tip is trimmed. The graph illustrates the infinite range of flow rates that can be achieved by progressive trimming of the tip, in particular demonstrating specific rates achieved according to the three cases depicted in FIG. 4*a*.

DETAILED DESCRIPTION OF THE PREFERRED EMBODIMENT

Figure 1:
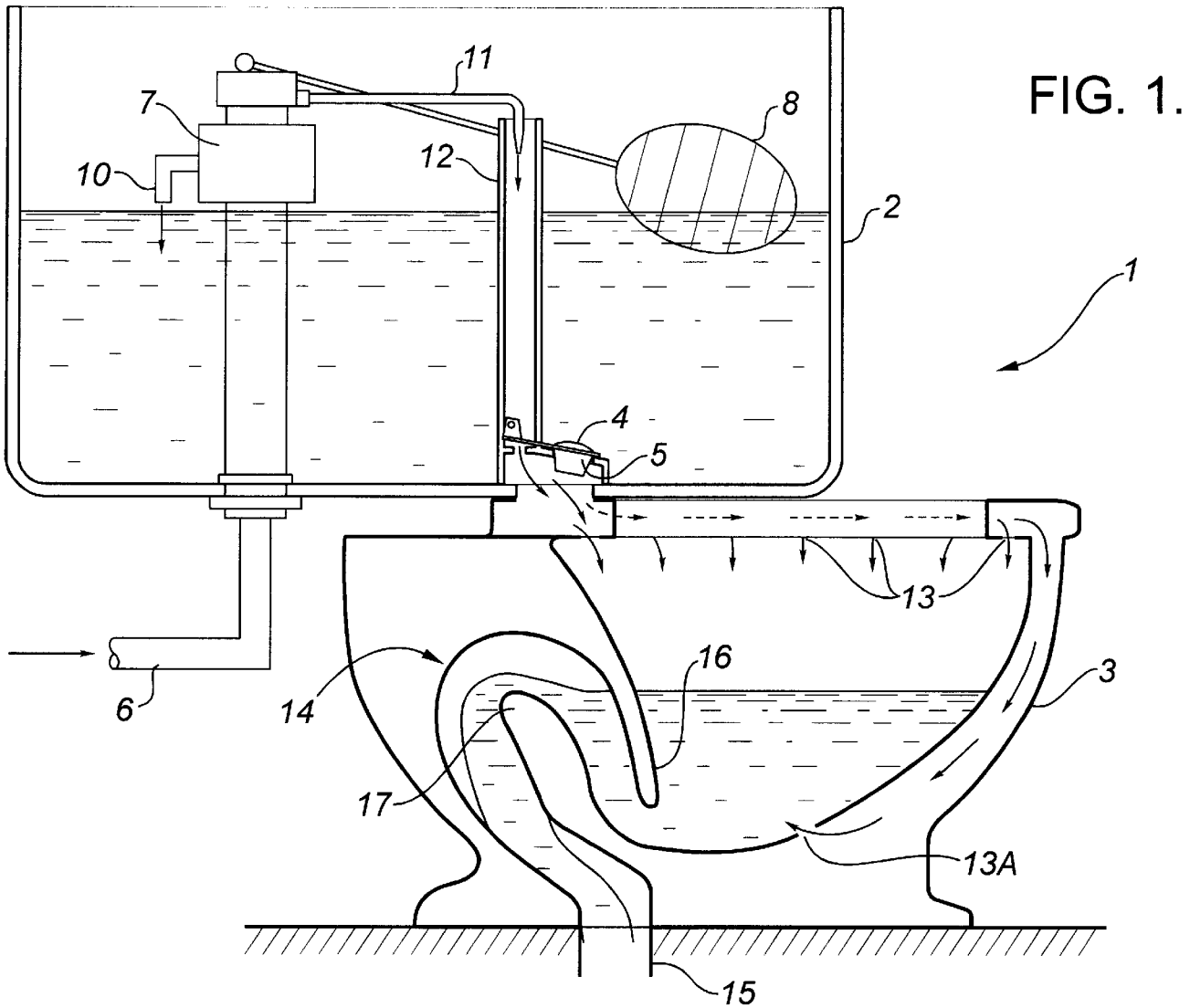
FIG. 1 is a cross sectional view of a domestic toilet.

Having reference to FIG. 1, a toilet 1 comprises a water tank 2, and toilet bowl 3. For illustrative purposes, the tank 2 is shown rotated 90 degrees from its conventional orientation on the bowl 3. A flush valve 4 is seated in a passageway 5 between the tank 2 and the bowl 3. The tank 2 receives water from water supply 6. A water intake valve or ballcock 7, and a float ball 8 are operable to control the inflow of water from supply 6. The float ball 8 floats on the tank's water and closes ballcock 7 when the tank is full.

Ballcock 7 directs water to two discharges: a tank refill tube 10 for directing water to refill the tank 2; and a bowl refill tube 11 for directing water to refill the toilet bowl 3. Tube 10 is referred to in the claims as the first tube; tube 11 is referred to as the second tube. An overflow pipe 12 extends upwardly from the toilet bowl 3. Should the ballcock 7 fail, excess water from the tank 2 will flow into the overflow pipe 12. Additionally, water from the bowl refill tube 11 also flows into the overflow tube 12. Water in the overflow tube 12 flows into the toilet bowl 3 through a variety of bowl openings in the rim 13 and through a siphon jet hole 13*a*.

The bowl 3 has a trap 14 leading to the sewer 15. Trap 14 incorporates an underflow weir 16 and an overflow weir 17 which act to retain water in the bowl 3 so as to form a water seal. The seal prevents gas from flowing passing freely up from the sewer 15.

In operation, flush valve 4 is lifted by a handle and chain (not shown), opening passageway 5. Water stored in the tank 2 flows through passageway 5 and into the bowl 3 through bowl openings 13,13*a*, flushing the bowl's contents through the trap 14 and into the sewer 15. A siphon effect is created, drawing water out of the bowl 3 until the water level falls below the underflow weir 16.

As the water in the tank 2 flows through passageway 5, the water level in the tank drops. The float ball 8 also drops, opening ballcock 7, which initiates the flow of water through the tank and bowl refill tubes 10, 11.

The water exits the tank faster than the tank refill tube 10 can refill the tank 2. Accordingly, the tank's water level drops. When the tank 2 is nearly empty, the flush valve 4 closes and the tank refill tube 10 flow begins to refill the tank 2.

While the tank is refilling, the bowl refill tube 11 directs water down the overflow tube 12 to refill the bowl 3. The maximum bowl water level is that set by the overflow weir 17. Once that maximum level is reached, water overflows the weir 17 is and is lost down the sewer 15.

Thus far, the description represents both the operation of the prior art toilet and a toilet implementing the present invention.

The invention comprises an improvement to the toilet bowl refill tube 11. The improvement prevents waste attributed to the loss of water down the sewer 15 due to an overfilling of the toilet bowl 3.

Figure 2:
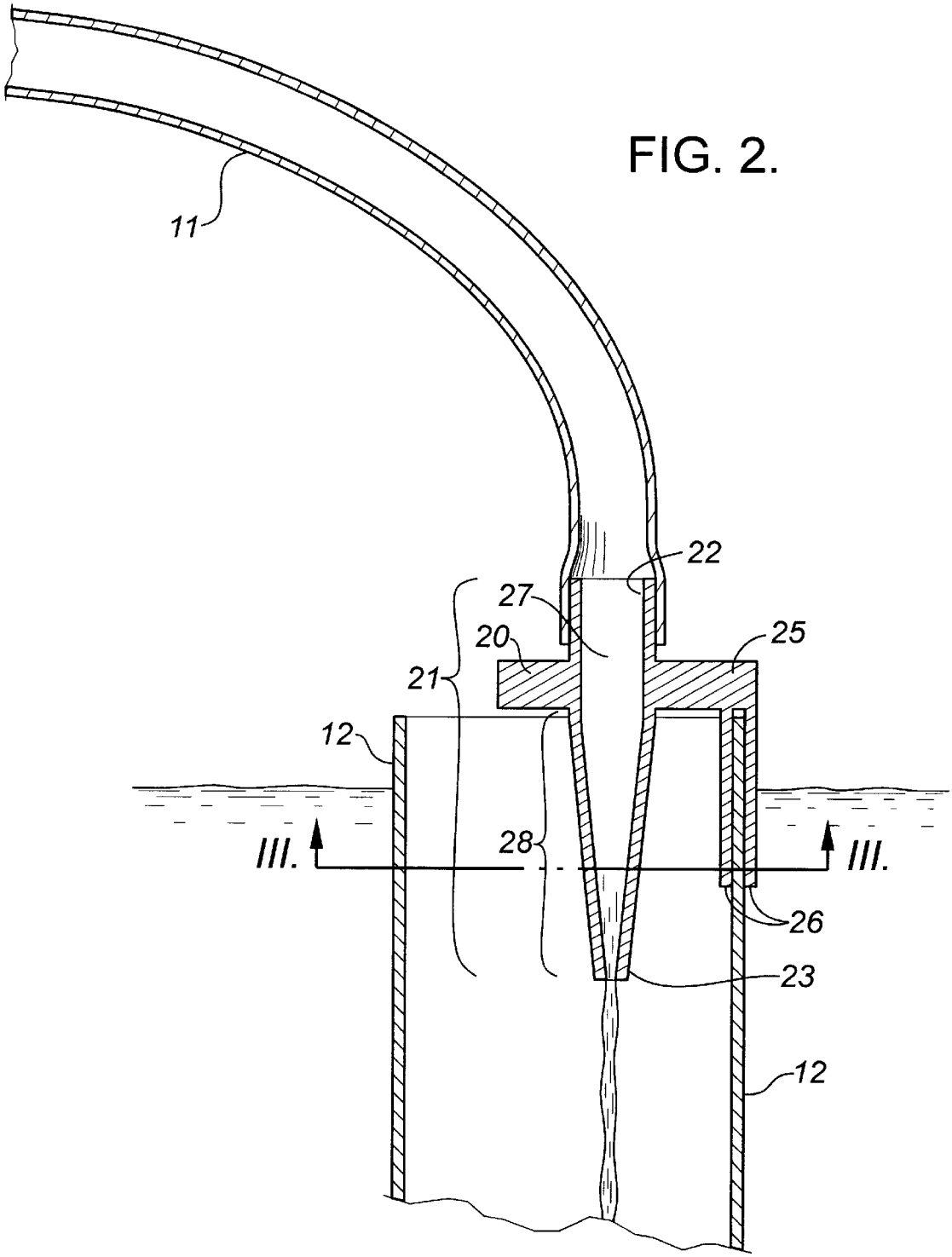
FIG. 2 illustrates a flow-restriction tip, connected to the discharge of the bowl refill tube, according to the preferred embodiment of the present invention.

Having reference to FIG. 2, a flow-restricting tip 20 of the present invention is provided at the discharge end of an existing bowl refill tube 11.

After the toilet is flushed, the tank and bowl refill tubes 10,11 simultaneously flow make-up water to their respective tank 2 and bowl 3. As described above, one valve, the ballcock 7, controls the flow to both the tank and bowl refill tubes 10,11. The ballcock 7 continues to supply water to the tank and bowl refill tubes 10,11 as long as the tank 2 is not full.

If the bowl 3 refills before tank 2 is refilled, then the ballcock 7 continues to supply water to the bowl refill tube 11 and discharge water to the bowl 3. This excess water from the bowl refill tube 11 enters the bowl 3, overflows weir 17 and is lost down the sewer 15.

Accordingly, the flow-restricting tip 20 acts to restrict the flow of water to the bowl 3. Tip 20 comprises a conduit 21 having an intake end 22 and an outlet end 23. Intake end 22 is connected to the discharge end of the refill tube 11, preferably by stretching tube 11 over the intake end 22.

Means 25 secure tip 20 to the overflow tube 12 and ensure the outlet end 23 is directing into the tube 12. Referring also to FIG. 3, means 25 preferably comprise a pair of parallel, spaced prongs 26. The spacing of the prongs 26 is substantially equal to the thickness of the wall of the overflow tube 12 so that, when installed, they frictionally engage the tube's wall and thereby secure the flow-restriction tip 20 to the overflow tube 12. Conveniently, the prongs 26 are integrally formed with the tip 20.

Conduit 21 has a bore 27 extending therethrough. The diameter of the bore 27, at the intake end 22, is larger than the diameter of the bore at the outlet end 23. Bore 27 has a tapered section 28 over which the diameter of the bore 27 diminishes continuously. As shown in FIG. 2, the bore 27 diminishes linearly. Preferably, the diameter at the outlet end 23 diminishes to zero, restricting the flow completely.

Tapered section 28 is formed of readily cut material such as plastic. Accordingly, the tapered section 28 may be progressively cut or trimmed back from the outlet end 23, toward the intake end 22 forming a new outlet end having progressively larger diameters. The larger the diameter of the bore, the greater is the flow therefrom.

By cutting the conduit 21 transversely at any point intermediate of the tapered section 28, the amount of flow restriction is selected from substantially infinite number of choices. This permits the bowl refill rate to be balanced precisely to match the toilet's particular tank refill characteristics.

In operation, the process by which the refill rates of the tank 2 and the bowl 3 are balanced is as follows. The user sets an objective water level in the bowl 3 which is equal to the height of the bowl's water level at the water overflow weir 17, or at a lower level. The level must be equal to or greater than that required to maintain a water seal at the trap 14. This level can be temporarily marked. The toilet is flushed. If the water level in the bowl 3 reaches the overflow weir 17 mark before tank 2 fills, then water is needlessly being lost down the sewer 15. If it surpasses the objective level, then the bowl refill flow needs to be restricted.

Tip 20 is installed on the end of the bowl refill tube 11, restricting the refill rate of the bowl 3. Again, the toilet is flushed. If the operating water level in the bowl 3 does not reach the objective level, then the tip is too restrictive. The tapered section 28 of the tip 20 is cut back with scissors, exposing a larger diameter bore 27 which permits greater water flow. The toilet is flushed again to repeat the process. The tapered section 28 is repeatedly and progressively trimmed back until bore 27 is large enough to permit the bowl 3 to fill to the objective water level simultaneously with the tank 2 becoming full. This approach achieves a optimum water level in the bowl without wastage.

Figure 5A:
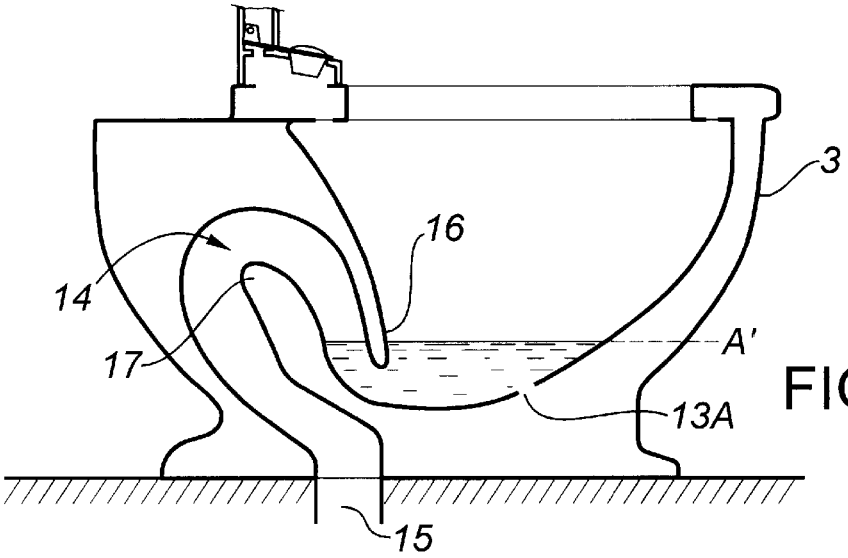
FIG. 5*a*, 5*b* and 5*c* illustrate the resulting toilet bowl water levels and water loss according to the three cases depicted in FIG. 4*a*.
Figure 5B:
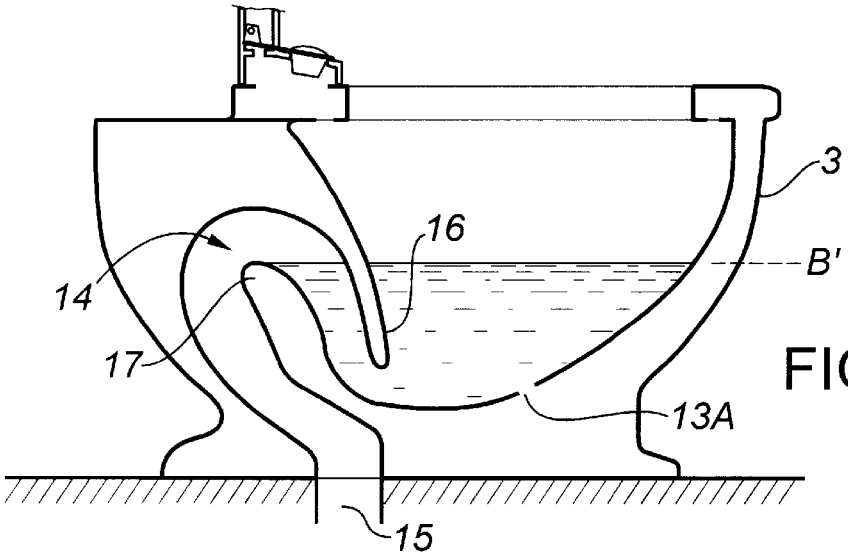
Figure 5C:
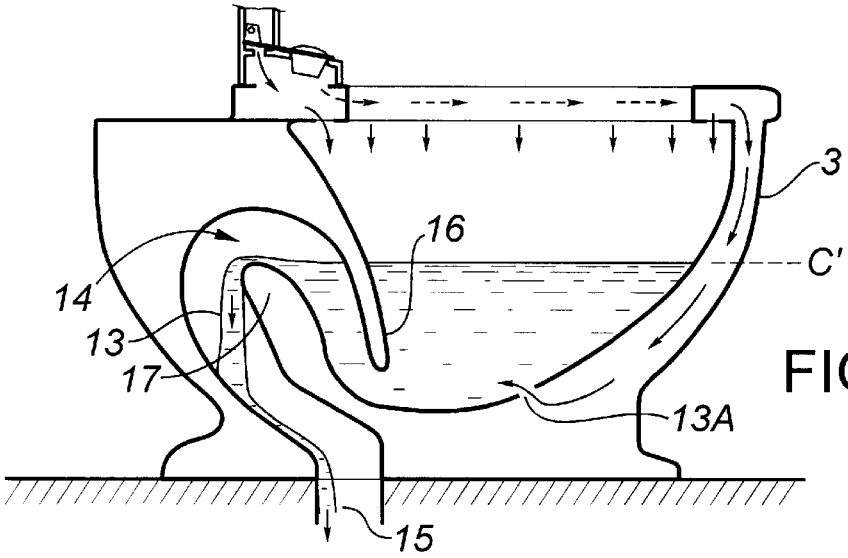

Having reference now to FIGS. 4*a*, 4*b*, the effect of successive trimming of the tapered section 28 is depicted (FIG. 4*a*) by comparison directly to the resulting flow (FIG. 4*b*). The effect on the water level in the bowl 3 is shown in FIGS. 5*a*, 5*b* and 5*c*. Three selected cases A, B, C are shown as follows.

In case A, tip 20 is not trimmed at all and the diameter of the bore at the outlet end 23 is effectively zero (FIG. 4*a*). As shown in FIG. 4*b*, no water is discharged from the tip 20. Case A provides the most savings in water usage. Here, cleansing of the bowl relies solely on the emptying of the tank's stored water. As the cleanliness of the bowl is partially dependent on the quantity of water in the bowl, the cleaning in this case is not very effective. However, as long as the water seal is maintained, the toilet operates safely. In FIG. 5*a*, the water level A' just achieves a seal at the underflow weir 16.

In case B, the tip's conduit 21 is trimmed to an length intermediate along the length of its tapered section 28 (FIG. 4*a*). Ideally, the resulting flow rate (FIG. 4*b*) provides a bowl refill rate which balances both the tank and bowl refill rates. Correspondingly, in FIG. 5*b*, the water level B' achieves the optimal and maximum level without losing water over overflow weir 17 to the sewer 15.

In case C, the tapered section 28 is trimmed further yet. In this case, the resulting flow rate (FIG. 4*b*) refills the bowl before the tank fills (FIG. 5*c*). This result is illustrated as a slightly elevated level C' and a flow of water 30 which is discharged over overflow weir 17 and into the sewer 15, wasting water.

While only three cases are depicted above, the tip's conduit 21 can be cut at any location intermediate along the tapered section 28, providing an exact flow rate which balances both the tank and bowl refill rates, as is depicted in Case B. The tapered section is depicted as having a linearly diminishing bore, but other profiles can be applied.

Additionally, while the flow-restricting tip is shown as apparatus independent from the refill tube 11, it can also be formed as part of other portions of the toilet hardware, including being formed integrally with the discharge end of the bowl refill tube, or as part of the overflow tube.

I claim:

1. A method for balancing the refilling of the tank and bowl of a toilet with water after a flush of the tank's contents through the bowl and down a sewer, the toilet having a source of make-up water for refilling both the tank and bowl the supply of which is only discontinued when the tank is completely refilled, the tank being refilled by conducting the make-up water through the bore of a first tube and the bowl being refilled by conducting the make-up water through the bore of a second tube, the bowl having a maximum fill level above which excess water flows to the sewer, the bore of the second tube being capable of conducting sufficient water to refill the bowl before the first tube refills the tank and thus resulting in excess bowl refill water which is wasted down the sewer after each flush, comprising the steps of:

(a) installing a flow-restricting conduit within the second tube, the conduit having an inlet end, and outlet end and a bore, the bore adjacent the outlet end diminishing in diameter to a small diameter at the outlet end for restricting the flow of refill water from the outlet end of the second tube so that the flow of water therefrom is insufficient to fill the bowl before the tank completely refills;

(b) flushing the toilet and establishing the level ot water in the bowl at the time the tank completely refills;

(c) trimming the conduit intermediate along its diminishing bore to form a new outlet end having a larger bore than that of the previous outlet end so that the flow of water is restricted less than it had been previously and the bowl refills more quickly; and (d) repeating steps (b) and (c) until the level of water in the bowl after a flush is just equal to or is less than the bowl's maximum fill level so that the bowl does not overfill before the tank refills.

2. The method as recited in claim 1 wherein the bowl has a minimum fill level necessary to form a water seal between the bowl and the sewer further comprising:

(a) establishing the maximum fill level;

(b) establishing an objective water level in the bowl which is equal to or less than the maximum fill level, the objective water level being equal to or greater than the minimum fill level such that a water seal is formed between the bowl and the sewer; and (c) repeating the flushing of the toilet, establishing the water level in the bowl and trimming of the conduit steps until the water level in the bowl is the same as the objective water level.

3. A combination toilet and a water-conserving flow-restricting device comprising:

a toilet having a water tank, a bowl, a water supply conducting make-up water to a tank refill tube and a bowl water refill tube, the tank communicating with the bowl and having a valve fitted therebetween for flushing the tank's water into the bowl, the bowl having an overflow weir to a sewer, and the bowl refill tube having a discharge end which, after a flush, conducts water from the water supply to the bowl at a rate sufficient to refill the bowl and flow excess water over the overflow weir and to the sewer before the tank refill tube conducts sufficient water to refill the tank; and a flow-restricting conduit having a bore, an inlet end communicating with the discharge end of the bowl refill tube, and an outlet end which directs water into the bowl, the bore being tapered adjacent the outlet end so that it diminishes continuously to the outlet end, the bore at the outlet end being too small to conduct enough make-up water to refill and overfill the bowl by the time the tank is refilled, the conduit being formed of material which is readily cut so that when the conduit is cut substantially transverse to its bore and intermediate along the tapered bore, it forms a new larger bore at the outlet end for conducting a greater flow of water through the bowl refill tube to the bowl.

* * * * *